US007424756B2

(12) United States Patent
Van Raemdonck

(10) Patent No.: US 7,424,756 B2
(45) Date of Patent: Sep. 16, 2008

(54) DEVICE FOR LIFTING PATIENT OR DISABLED PERSON

(75) Inventor: René Van Raemdonck, Zandbergen (BE)

(73) Assignee: Handi-Move International N.V., Ninove (BE)

( * ) Notice: Subject to any disclaimer, the term of this patent is extended or adjusted under 35 U.S.C. 154(b) by 16 days.

(21) Appl. No.: 10/839,219

(22) Filed: May 6, 2004

(65) Prior Publication Data

US 2005/0000016 A1 Jan. 6, 2005

(30) Foreign Application Priority Data

May 6, 2003 (EP) ..... 03447105

(51) Int. Cl.
*A47B 83/04* (2006.01)

(52) U.S. Cl. ..... 5/81.1 R; 5/87.1; 5/88.1

(58) Field of Classification Search ..... 5/81.1 R, 5/89.1, 87.1, 88.1; 4/560.1, 561

See application file for complete search history.

(56) References Cited

U.S. PATENT DOCUMENTS

| | | | | |
|---|---|---|---|---|
| 1,620,298 | A | 3/1927 | Smith | |
| 2,743,701 | A * | 5/1956 | Boyd | 119/728 |
| 4,509,785 | A * | 4/1985 | Van Raemdonck et al. | 294/118 |
| 4,882,798 | A * | 11/1989 | Worsnop | 5/89.1 |
| 6,192,534 | B1 | 2/2001 | Restivo | |

FOREIGN PATENT DOCUMENTS

| | | |
|---|---|---|
| DE | 4313494 A1 | 10/1994 |
| EP | 0094704 A1 | 11/1983 |
| FR | 2636232 A1 | 3/1990 |

* cited by examiner

*Primary Examiner*—Fredrick Conley
(74) *Attorney, Agent, or Firm*—Akerman Senterfitt

(57) ABSTRACT

A device for lifting a person, comprising a pair of cups (1, 2) for gripping a person by applying pressure force on opposite sides of the person's thorax (12) and moving means for moving the cups towards each other. The cups (1, 2) are tiltably mounted on the device, each cup (1, 2) having a tilt axis (A, B) which in use extends in a substantially horizontal direction along one of the opposite sides of the person's thorax (12). Each cup (1, 2) has a contact surface for contacting one of the opposite sides of the person's thorax (12), at least a part of which is located behind the tilt axis (A,B) with respect to the person's thorax.

58 Claims, 5 Drawing Sheets

DEVICE FOR LIFTING PATIENT OR DISABLED PERSON

This application claims priority from European Patent Application No. 03447105.2 filed May 6, 2003. The entirety of that application is incorporated herein by reference.

The present invention relates to a device for lifting a person, such as for example a patient or a disabled person, according to the preamble of the first claim.

From EP-A-94704, a device for lifting a person is known which comprises a pair of arms on which a pair of cups are mounted. The cups are provided for gripping a person to be lifted from opposite sides of the person's thorax and are shaped accordingly. The arms are connected to each other in a pivot, which is located above the cups, and extend further beyond this pivot in upper ends, which are used to suspend the arms from a suspension. In this way, a so-called "scissor effect" is achieved, which means that the cups are moved towards each other upon lifting the person, as a result of the person's own weight.

The device known from EP-A-94704, however has the disadvantage that if the thorax volume of the person who is lifted by means of the device is above or below average, there is a risk that the person is insufficiently gripped by the cups, so that the person may fall from between the cups.

From FR-A-2636232, a device for lifting a person is known which has tiltable cups. In order to adjust the device to different persons, the cups are tilted to a desired angle and then fixed in this angle. Devices of this kind are often used in institutions, where a large number of persons are treated. Consequently, adjustment of the angle of the cups of the device of FR-A-2636232 needs to be performed frequently. However, the nursing personnel in institutions does not always go through the trouble of adjusting the device, so that there is a risk that the orientation of the cups upon gripping a person is incorrect. As a result, there is still a risk of insufficient grip.

It is an aim of the present invention to provide a device for lifting persons with which the risk of insufficient grip can be reduced.

This aim is achieved according to the invention with a device showing the technical characteristics of the characterising part of the first claim.

An analysis of the problem of the prior art has shown that the placement of the cups on the person's thorax depends on the distance between the cups or, in other words, on the width or volume of the person's thorax. For thinner persons, the cups are moved too close to each other so that, due to the pivotal connection of the arms which carry the cups, the lower edges of the cups are closer towards each other than the upper edges. As a result, this person is gripped mainly by the lower edges instead of by the whole of the cups, so that the contact area between the cups and the person is very small. Similarly, for large persons the person is gripped mainly by the upper edges of the cups, so that the contact area is likewise very small. Due to the smaller contact area, there is less friction between the cups and the person, so that the person may come to hang on his/her armpits or even slide from between the cups and fall.

In the device according to the invention, the cups are tiltably mounted on the device and have tilt axes which in use extend in a substantially horizontal direction along the sides of the person's thorax. As a result, when the cups come into contact with the person's thorax, they can tilt and adjust their position on the shape of the person's thorax. In other words, the device of the invention is self-adjusting. This leads to a larger contact area between the cups and the person's thorax, irrespective of the shape of the thorax, so that the amount of friction between the cups and the person increases and the risk that the person comes to hang on his/her armpits or slides from between the cups is reduced. Furthermore, this makes the device of the invention suitable for gripping a larger number of persons, i.e. the range of persons which can be gripped by means of the device is increased. The cups may furthermore be tiltable in other directions, i.e. they may also have other tilt axes than the horizontal, so that the position of the cups and the magnitude of the contact area can be further improved.

Furthermore, the larger contact area between the cups add the thorax has the advantage that the pressure which is applied by the cups on the thorax and which is required for lifting the person is spread over a wider contact area. In other words, the pressure applied by the cups on the thorax is less concentrated. As a result, there is less risk that the person experiences pain upon being gripped.

Preferably, the tilt axis of each of the cups is chosen such that in use the pressure force which is applied by the cup onto the side of the person's thorax has a resultant with a point of application within a predetermined region on the contact surface between the cup and the thorax. It has been found according to the invention that the position of the tilt axis with respect to the contact surface between cup and thorax is a determining factor for the point of application of the resultant of the pressure force. Furthermore, it has been found according to the invention that if the point of application of the resultant is within a given region of the contact surface, the risk of insufficient grip is further reduced. In summary, a suitable choice of the position of the tilt axis with respect to the contact surface between cup and thorax can further improve the grip of the device of the invention.

Preferably, the position of the tilt axis with respect to the cup is chosen such that the predetermined region, in which the point of application of the resultant is located, is located substantially centrally on the contact surface of the cup or in a lower half of the contact surface of the cup. It has been found that the risk of insufficient grip is the least, if the point of application of the resultant of the pressure force applied by cup onto thorax is within a region in the centre or in the lower half of the contact surface of the cup.

Preferably, the cups have a concave shape, so that the cups are complementary to the shape of the person's thorax. The tilt axis of each cup preferably extends substantially centrally with respect to the contact surface of the cup—considering the cup in its neutral, vertical position. The position of the tilt axis of each cup is furthermore preferably chosen such that the predetermined region of the contact surface, in which the point of application of the resultant is located, is behind the tilt axis with respect to the person's thorax. This means that the tilt axis is preferably located in front of the region of the contact surface between cup and thorax in which the resultant of the pressure force applies. It has been found that this can further enhance the grip of the device of the invention. The distance between the tilt axis and the predetermined region of the point of application of the resultant is preferably 0.5 to 5 cm, more preferably 1 to 3 cm.

An alternative way of stating that, in use, the point of application of the resultant of the pressure force preferably applies substantially centrally or in the lower half of the cup is to state that at least half of the pressure applied by the cup on the side of the person's thorax is preferably located on the lower half of the cup. As has been mentioned above, this can be achieved by a suitable location of the tilt axis of the cup with respect to the contact surface of the cup.

In a preferred embodiment of the device of the invention, the device comprises means for moving the cups towards each other under the influence of the person's weight. In this way, the person can be gripped and lifted by means of pressure which results from the person's own bodyweight.

The means for moving the cups preferably comprise a pair of arms, each of which has a lower end on which one of the cups is tiltably mounted. These arms are pivotably connected to each other in a pivot which is located above the cups and have upper ends which extend beyond the pivot. The arms are suspended from a suspension by means of these upper ends. In this way, a construction is achieved in which the cups are moved towards each other under the influence of the person's own weight, without needing any additional drive means.

Each of the arms is preferably provided with a leg support on which the legs of the person to be lifted can be carried. Apart from improving the comfort of the person who is lifted, these leg supports also have the advantage that, since the weight of the legs is applied directly on the arms, the gripping force exerted on the person's thorax can be enhanced.

The tilting of the cups is preferably limited to about 15° with respect to their neutral, vertical position in each direction in which they are tiltable. This has the advantage that the cups are already almost in the correct position upon gripping the person. The limit may however also be more or less.

The invention will be further elucidated by means of the following description and the appended figures.

Figure 1:
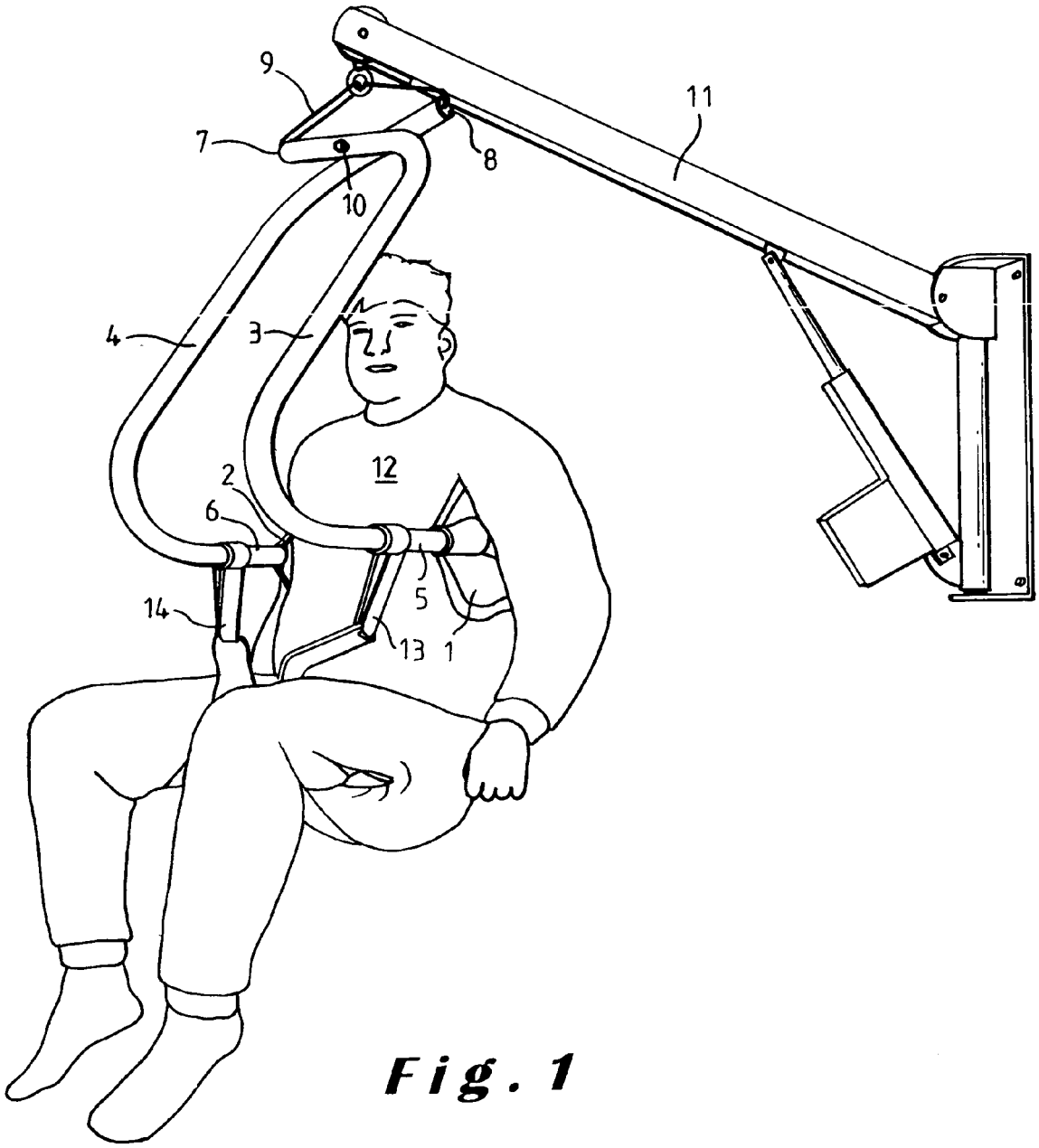
FIG. 1 shows a perspective view of a preferred embodiment of the device of the invention in use.
Figure 2:
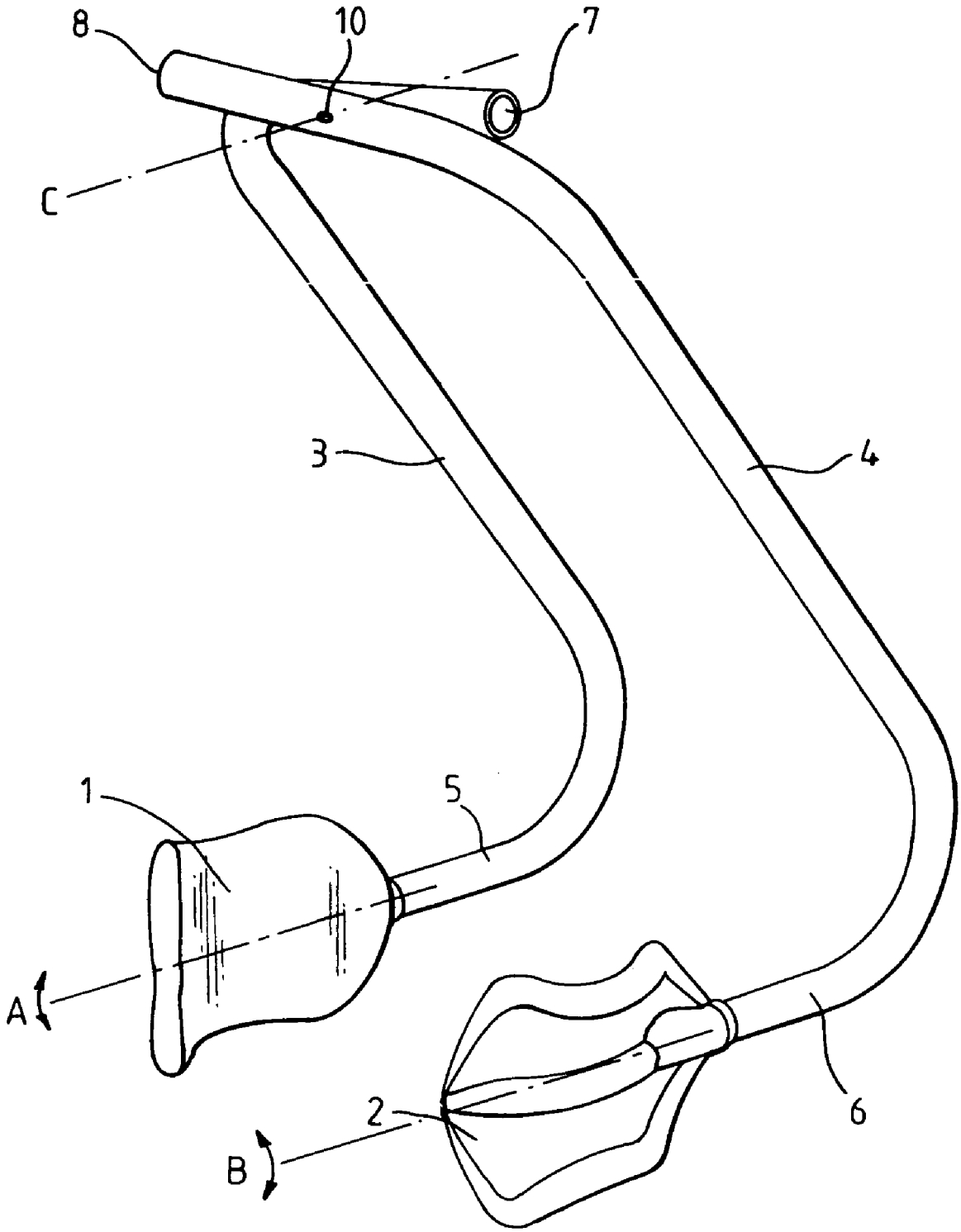
FIG. 2 shows a perspective view of the embodiment of FIG. 1.

The device of FIG. 1 comprises a pair of cups 1 and 2 for gripping a person on opposite sides of his/her thorax 12. The cups have a concave shape which is complementary to the shape of an average person's thorax 12 and are tiltably mounted on the lower ends 5 and 6 of a pair of arms 3 and 4. These arms are pivotably connected to each other in a pivot 10 and have upper ends 7 and 8 which extend beyond this pivot 10. The arms 3 and 4 are pivotable with respect to each other about a pivot axis C, which preferably extends substantially horizontal. The device is suspended from for example a wall-mounted arm 11 by means of hooks 9 or chains or other means, which connect the upper ends 7 and 8 to the arm 11. Due to this suspended pivotal construction, the arms 3 and 4 form means for moving the cups 3 and 2 towards each other under the influence of the person's weight. The device may however also have any other construction known to the person skilled in the art.

The cups 1 and 2 are tiltable about tilt axes A and B, which are substantially horizontal axes. In this way, any unsuitable angle of one or both cups 1, 2 with respect to the thorax 12 upon gripping, which could result from the arms 3 and 4 being pivoted less or more towards each other than average, can be compensated by a corresponding tilting of the cups. The cups 1, 2 may also be tiltably mounted about other axes, so that they have more degrees of freedom and their capacity to adjust to the thorax 12 can be further enhanced.

The maximum tilt of the cups 1 and 2 is in both directions limited to an angle of for example 15° with respect to the vertical position of the cups, so that they are initially already directed towards the person's thorax 12. This tilt limitation can for example be achieved by means of internal stops (not shown) in the arms 3, 4 or by other means known to the person skilled in the art.

The cups 1 and 2 are preferably provided with a soft covering or a layer of a soft material for accommodating to irregularities on the surface person's thorax 12 and enlarging the contact area between the cup 1, 2 and the thorax 12. This soft covering or soft material can be any one which is known to the person skilled in the art.

The tilt axis A and B of each of the cups 1 and 2 is chosen such that in use the pressure force which is applied by the cup onto the side of the person's thorax 12 has a resultant R with a point of application d within a predetermined region 15 (FIG. 5) on the contact surface between the cup 1, 2 and the thorax 12. It has been found that the position of the tilt axis A, B with respect to the contact surface between cup 1, 2 and thorax 12 is a determining factor for the point of application d of the resultant R of the pressure force. Furthermore, it has been found that if the point of application d of the resultant R is within a given region 15 of the contact surface, the risk of insufficient gripping of the person is reduced. In summary, in the device of FIG. 1, a suitable choice of the position of the tilt axis A and B with respect to the contact surface between cup 1, 2 and thorax 12 can further improve the grip of the device.

The tilt axes A and B are chosen such that, on each of the cups 1 and 2, the predetermined region 15, in which the point of application d of the resultant R is located, is a substantially central region or a region in the lower half of the contact surface of the cup 1, 2. This means that the resultant R has its point of application d in a region 15 which extends slightly above the centre of the cup 1, 2 or below this centre. It has been found that the risk of insufficient grip is the least, if the point of application of the resultant of the pressure force applied by cup onto thorax is within this region 15.

Figure 3:
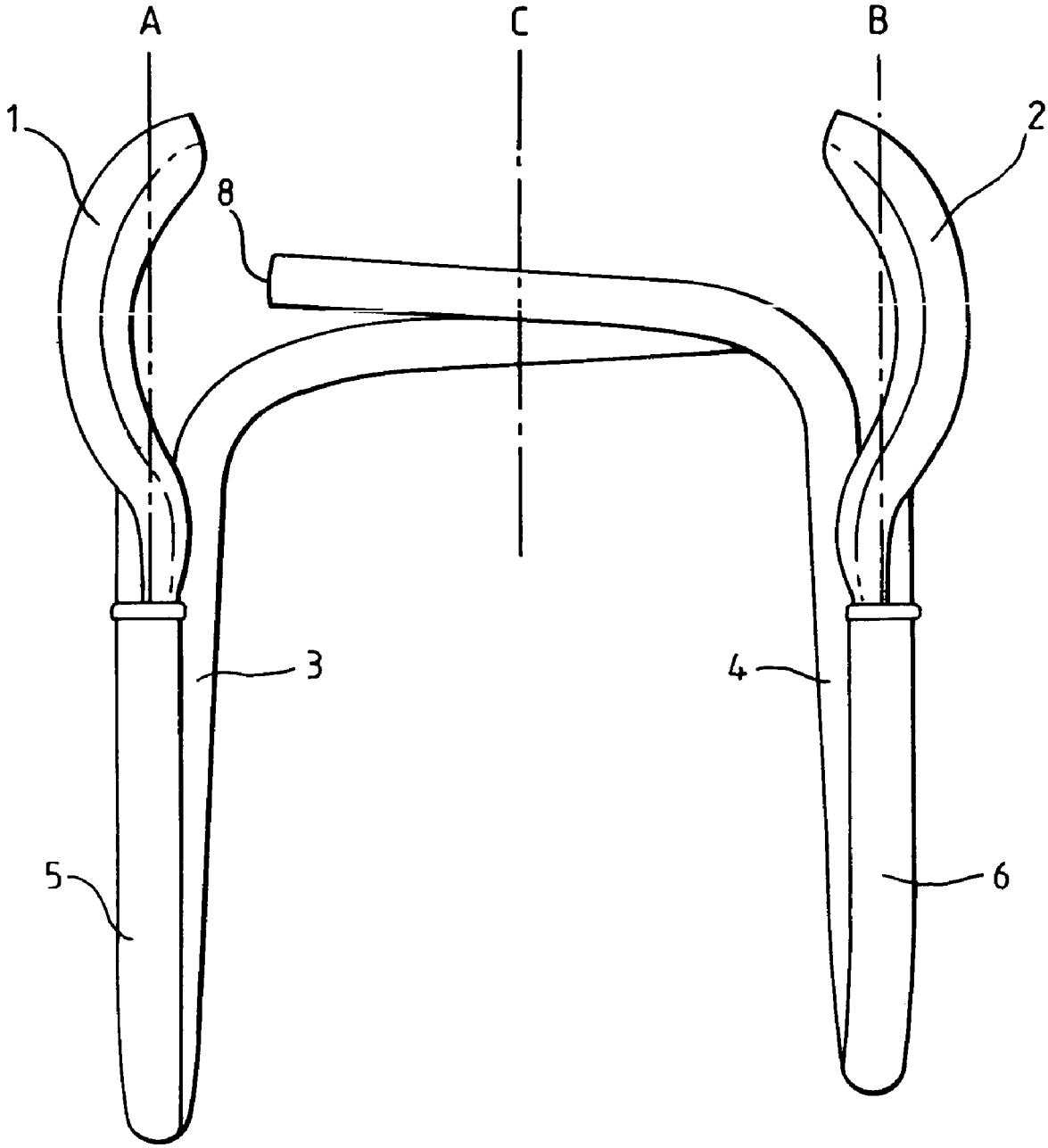
FIG. 3 shows a bottom view of the embodiment of FIG. 1.
Figure 4:
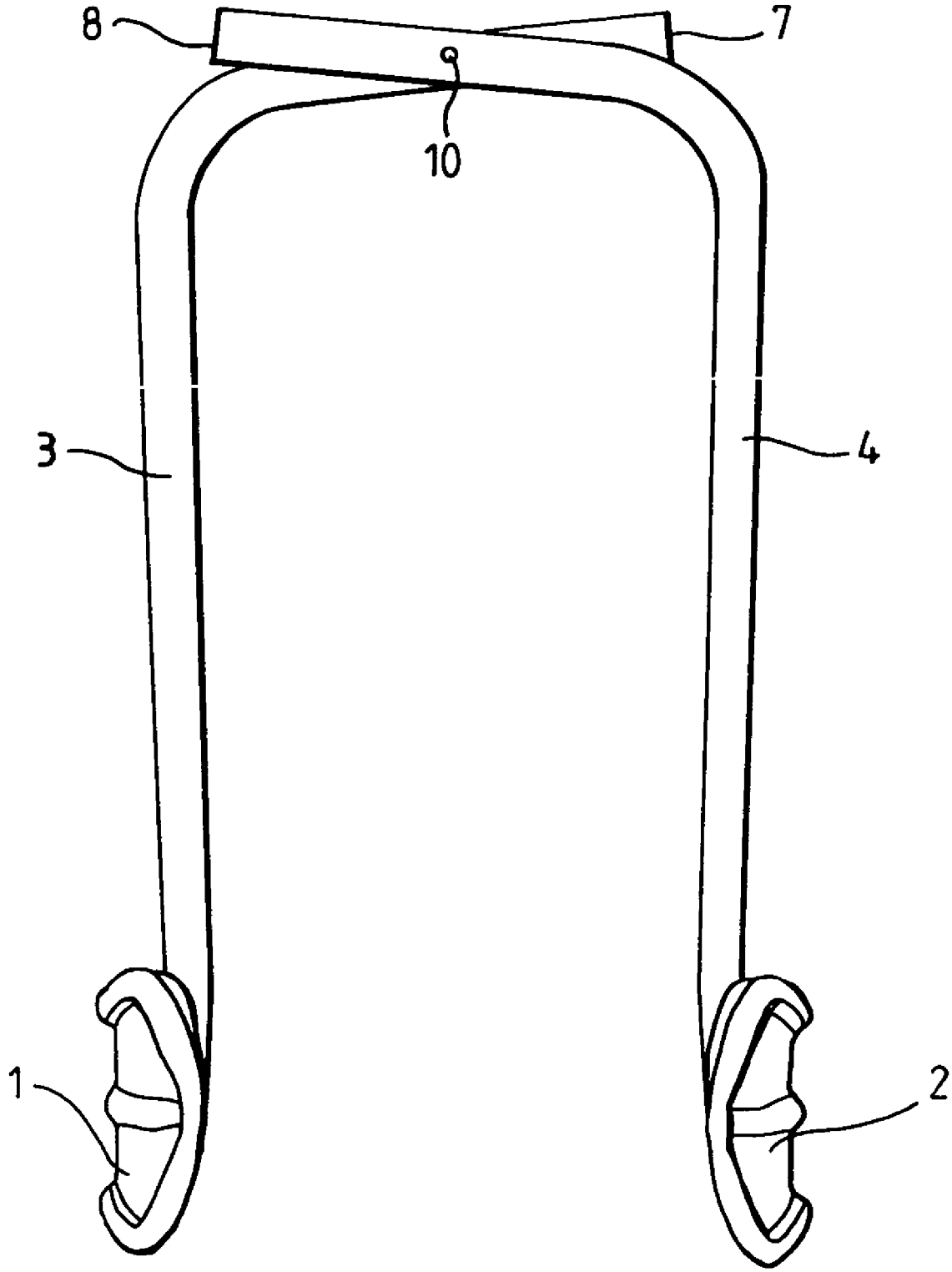
FIG. 4 shows a front view of the embodiment of FIG. 1.

The cups 1 and 2 have a concave contact surface for contacting the sides of the thorax 12. In the device of FIG. 1, this concave shape is substantially symmetrical with respect to a horizontal plane extending centrally through the cups 1, 2. This has the advantage that the upper half of the cup 1, 2 mirrors the lower half, so that both cups 1 and 2 can be constructed by means of one and the same mould and production costs can be saved. As can be seen on FIG. 3, the cups 1, 2 are slightly extended, so that they can better support the back of the person. The cups may however also have any other shape known to the person skilled in the art.

The rotation axis A, B of each of the cups 1, 2 is chosen such that the centre of the concave contact surface is located behind the axis A, B with respect to the thorax 12. This means that the tilt axis A, B is in front of the centre of the contact surface of the cup 1, 2 with respect to the thorax 12.

The tilt axis A, B is located in a horizontally central position with respect to the cup 1, 2. This means that—with the cups 1, 2 in their neutral, vertical position as shown—the horizontal plane of the tilt axis A, B divides the cup 1, 2 into two halves of substantially equal height. The tilt axis A, B may however also be raised or lowered with respect to the centre of the cup 1, 2.

The device of FIG. 1 operates as follows. When a person's weight is applied to the device, it reacts by moving the cups 1, 2 towards each other. This is achieved by the pivotal and suspended construction of the arms 3, 4, on which the cups 1, 2 are mounted. These cups have a rounded shape complementary to an average person's thorax. For lifting the person, the cups 1, 2 exert a pressure force onto the person's thorax 12. This pressure force is such that the friction between the cups 1, 2 and the thorax 12 is sufficient for counteracting the gravity force of the earth on the person, so that he/she can be lifted. In other words, although the person is gripped underneath his/her armpits, the person is lifted by a frictional engagement between the surfaces of the cups 1, 2 and the thorax 12 rather than by applying an upwards lifting force under the armpits, which would cause the person to hang on the cups 1, 2 and could be painful for the person, or could lead to the person sliding from between the cups if the person has insufficient shoulder strength.

The movement of the cups 1, 2 towards each other is enhanced by the leg supports 13, 14, in which the legs of the person are hung. The action of the earth's gravity on the legs causes a direct force moving the cups 1, 2 towards each other, so that the gripping force is enhanced. Furthermore, the leg supports 13, 14 move part of the person's weight from the cups 1, 2 to the lower ends 5, 6 of the arms 3, 4, so that the amount of weight to be lifted by the cups 1, 2 and consequently their pressure force on the thorax 12 is reduced. This makes the lifting of persons even more comfortable.

Figure 6:
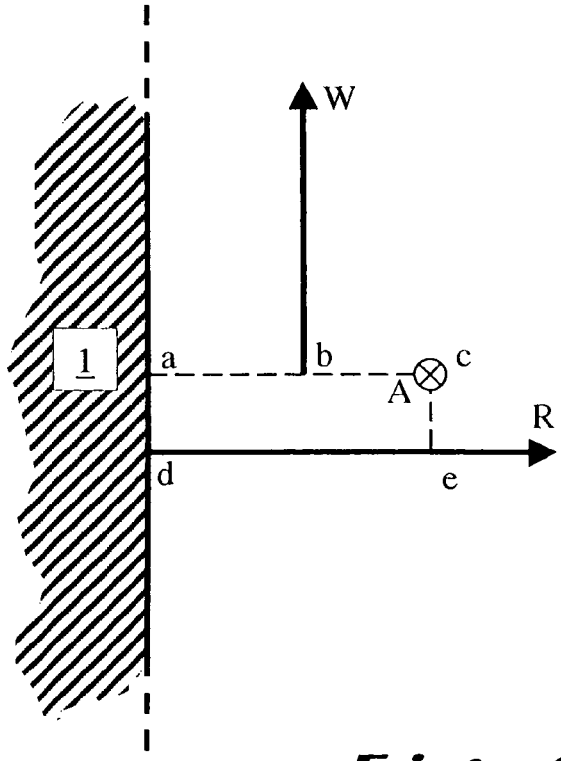
FIG. 6 shows the balance of moments on the cups of the embodiment of FIG. 1.

When holding the person, the force balance on the cups is the following (cf. FIG. 6):

$$R.[ce]=W.[bc]$$

Wherein: R=the resultant of the pressure force exerted by the cup 1 onto the thorax 12; [ce]=[ad]=the distance between the point of application of R and the tilt axis A; W=the resultant of the friction force exerted by the cup 1 onto the thorax 12; [bc]=the distance between the point of application of W and the tilt axis A.

R and W will adjust themselves to the static balance and can be calculated. As a result, if one of the distances [ce] and [bc] is set, the other is fixed. From the theory of mechanics it is further known that $W \leqq R$, so that $[ce] \leqq [bc]$.

According to the invention, the tilt axis A of the cup 1 is chosen such that at least the central part, but preferably most or all of the contact surface of the cup 1 for engaging the thorax 12 is located behind the tilt axis A, with respect to the thorax 12. The point of application of the friction resultant W is normally located behind this axis A, more particularly somewhere in between the surface of the cup 1 and the axis A (cf. FIG. 6: b is between a and c). In other words, the distance [bc] is normally a positive value, so that also [ce] is a positive value and R has its point of application d in the lower half of the cup 1, below the tilt axis A.

In other words, the tilt axis A of the cup 1 is chosen such that most of the pressure force is delivered by the lower half of the cup 1. This has the advantage that the lower half of the cup 1 is more pressed onto the thorax 12 than the upper half, which can further improve the gripping of the person.

Figure 5:
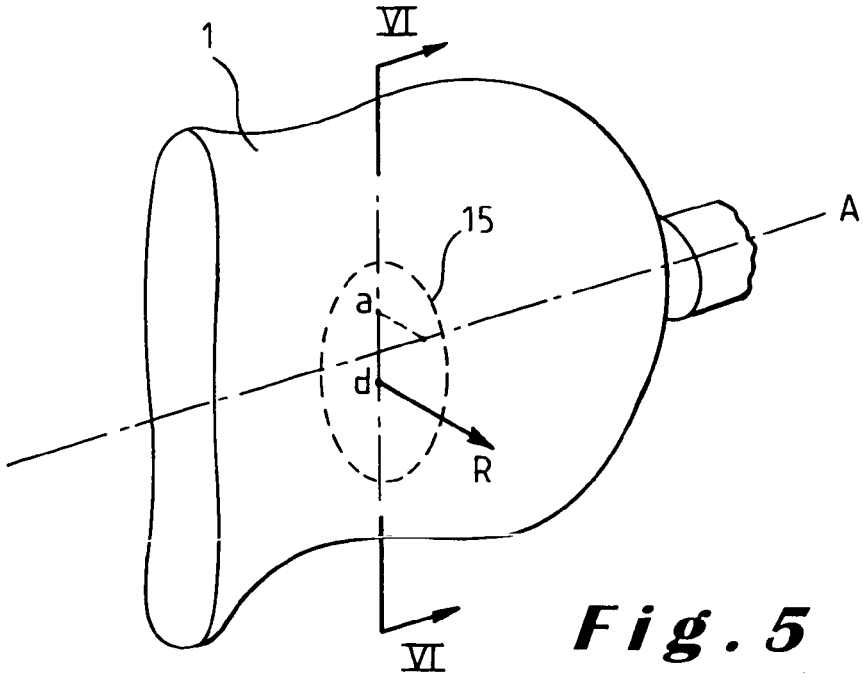
FIG. 5 shows a detail of a cup of the embodiment of FIG. 1.

FIG. 5 shows the region 15 on the contact surface of the cup 1 in which the point of application d of the pressure resultant R is preferably located. It is stressed that the region 15 in FIG. 5 is drawn arbitrarily and gives an idea of the most suitable region for the point of application d of the pressure resultant R, but is not absolute since the location of d strongly depends on the person. According to the invention, the region 15 results from a suitable choice of the location of the rotation axis A of the cup 1. As shown in FIG. 5, the preferred region 15 for the point of application d of the pressure resultant R is a central region which extends below and also slightly above the centre of the cup 1.

The distance [ac] between the region 15, i.e. the central part of the cup 1 and the tilt axis A is preferably 0.5 to 5 cm, more preferably 1 to 3 cm.

REFERENCE LIST

| | |
|---|---|
| 1 | cup |
| 2 | cup |
| 3 | arm |
| 4 | arm |
| 5 | lower end |
| 6 | lower end |
| 7 | upper end |
| 8 | upper end |
| 9 | hook |
| 10 | pivot |
| 11 | wall-mounted arm |
| 12 | thorax |
| 13 | leg support |
| 14 | leg support |
| 15 | region |
| A | tilt axis |
| B | tilt axis |
| C | pivot axis |
| R | resultant pressure force |
| W | resultant friction force |
| ce = ad | distance between tilt axis A and point of application of R |
| bc | distance between tilt axis A and point of application of W |

The invention claimed is:

1. A device for lifting a person, comprising a pair of cups for gripping a person by applying pressure force on opposite sides of the person's thorax, moving means for moving the cups towards each other under the influence of the person's weight, said moving means comprising a pair of arms, each having a portion with a substantially horizontal axis, wherein each cup is freely tiltably mounted on one of said arm portions around a tilt axis which is collinear with said substantially horizontal axis which in use extends in a substantially horizontal direction along one of the opposite sides of the person's thorax, wherein each cup has a thorax gripping surface for gripping one of the opposite sides of the person's thorax, the thorax gripping surfaces of the cups facing each other, and wherein for each cup considered in a neutral, vertical position at least a part of its thorax gripping surface is located behind its tilt axis with respect to the cup.

2. The device of claim 1, characterized in that the location of the tilt axis with respect to the contact surface is chosen such that in use the pressure force applied by the cup onto the side of the person's thorax has a resultant (R) with a point of application (d) within a predetermined region on said part of the contact surface, the predetermined region being located centrally or in a lower half of the contact surface.

3. The device of claim 2, characterized in that the distance between the predetermined region and the tilt axis is 0.5 to 5 cm.

4. The device of claim 3, characterized in that each cup comprises an upper half and a lower half, the location of the tilt axis with respect to the contact surface of each cup being chosen such that in use at least half of the pressure applied by the cup on the side of the person's thorax is located on the lower half.

5. The device of claim 4, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

6. The device of claim 5, characterized in that the tilting of the cups is limited to 15° with respect to their neutral, vertical position in each direction.

7. The device of claim 4, characterized in that the tilting of the cups is limited to 15° with respect to their neutral, vertical position in each direction.

8. The device of claim 3, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

9. The device of claim 8, characterized in that the tilting of the cups is limited to 15° with respect to their neutral, vertical position in each direction.

10. The device of claim 3, characterized in that the tilting of the cups is limited to 15° with respect to their neutral, vertical position in each direction.

11. The device of claim 2, characterized in that the contact surface of each cup has a concave shape and that—considering the cup in a neutral, vertical position—the tilt axis extends substantially centrally with respect to the contact surface of the cup.

12. The device of claim 11, characterized in that the distance between the predetermined region and the tilt axis is 0.5 to 5 cm.

13. The device of claim 12, characterized in that each cup comprises an upper half and a lower half, the location of the tilt axis with respect to the contact surface of each cup being chosen such that in use at least half of the pressure applied by the cup on the side of the person's thorax is located on the lower half.

14. The device of claim 13, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

15. The device of claim 14, characterized in that the tilting of the cups is limited to 15° with respect to their neutral, vertical position in each direction.

16. The device of claim 13, characterized in that the tilting of the cups is limited to 15° with respect to their neutral, vertical position in each direction.

17. The device of claim 12, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

18. The device of claim 17, characterized in that the tilting of the cups is limited to 15° with respect to their neutral, vertical position in each direction.

19. The device of claim 12, characterized in that the tilting of the cups is limited to 15° with respect to their neutral, vertical position in each direction.

20. The device of claim 11, characterized in that each cup comprises an upper half and a lower half, the location of the tilt axis with respect to the contact surface of each cup being chosen such that in use at least half of the pressure applied by the cup on the side of the person's thorax is located on the lower half.

21. The device of claim 20, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

22. The device of claim 21, characterized in that the tilting of the cups is limited to 15° with respect to their neutral, vertical position in each direction.

23. The device of claim 20, characterized in that the tilting of the cups is limited to 15° with respect to their neutral, vertical position in each direction.

24. The device of claim 11, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

25. The device of claim 24, characterized in that the tilting of the cups is limited to 15° with respect to their neutral, vertical position in each direction.

26. The device of claim 11, characterized in that the tilting of the cups is limited to 15° with respect to their neutral, vertical position in each direction.

27. The device of claim 2, characterized in that each cup comprises an upper half and a lower half, the location of the tilt axis with respect to the contact surface of each cup being chosen such that in use at least half of the pressure applied by the cup on the side of the person's thorax is located on the lower half.

28. The device of claim 27, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

29. The device of claim 28, characterized in that the tilting of the cups is limited to 15° with respect to their neutral, vertical position in each direction.

30. The device of claim 27, characterized in that the tilting of the cups is limited to 15° with respect to their neutral, vertical position in each direction.

31. The device of claim 2, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

32. The device of claim 31, characterized in that the tilting of the cups is limited to 15° with respect to their neutral, vertical position in each direction.

33. The device of claim 2, characterized in that the tilting of the cups is limited to 15° with respect to their neutral, vertical position in each direction.

34. The device of claim 1, characterized in that the contact surface of each cup has a concave shape and that—considering the cup in a neutral, vertical position—the tilt axis extends substantially centrally with respect to the contact surface of the cup.

35. The device of claim 34, characterized in that the distance between the predetermined region and the tilt axis is 0.5 to 5 cm.

36. The device of claim 35, characterized in that each cup comprises an upper half and a lower half, the location of the tilt axis with respect to the contact surface of each cup being chosen such that in use at least half of the pressure applied by the cup on the side of the person's thorax is located on the lower half.

37. The device of claim 36, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

38. The device of claim 37, characterized in that the tilting of the cups is limited to 15° with respect to their neutral, vertical position in each direction.

39. The device of claim 36, characterized in that the tilting of the cups is limited to 15° with respect to their neutral, vertical position in each direction.

40. The device of claim 35, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

41. The device of claim 40, characterized in that the tilting of the cups is limited to 15° with respect to their neutral, vertical position in each direction.

42. The device of claim 35, characterized in that the tilting of the cups is limited to 15° with respect to their neutral, vertical position in each direction.

43. The device of claim 34, characterized in that each cup comprises an upper half and a lower half, the location of the tilt axis with respect to the contact surface of each cup being chosen such that in use at least half of the pressure applied by the cup on the side of the person's thorax is located on the lower half.

44. The device of claim 43, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

45. The device of claim 44, characterized in that the tilting of the cups is limited to 15° with respect to their neutral, vertical position in each direction.

46. The device of claim 43, characterized in that the tilting of the cups is limited to 15° with respect to their neutral, vertical position in each direction.

47. The device of claim 34, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

48. The device of claim 47, characterized in that the tilting of the cups is limited to 15° with respect to their neutral, vertical position in each direction.

49. The device of claim 34, characterized in that the tilting of the cups is limited to 15° with respect to their neutral, vertical position in each direction.

50. The device of claim 1, characterized in that each cup comprises an upper half and a lower half, the location of the tilt axis with respect to the contact surface of each cup being chosen such that in use at least half of the pressure applied by the cup on the side of the person's thorax is located on the lower half.

51. The device of claim 50, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

52. The device of claim 51, characterized in that the tilting of the cups is limited to 15° with respect to their neutral, vertical position in each direction.

53. The device of claim 50, characterized in that the tilting of the cups is limited to 15° with respect to their neutral, vertical position in each direction.

54. The device of claim 1, characterized in that each of the arms has a lower end on which one of the cups is tiltably mounted, the arms being pivotably connected to each other in a pivot which is located above the cups, the arms having upper ends which extend beyond the pivot, the arms being suspended from a suspension by means of their upper ends.

55. The device of claim 54, characterized in that each arm is provided with a leg support for supporting a leg of the person.

56. The device of claim 55, characterized in that the tilting of the cups is limited to 15° with respect to their neutral, vertical position in each direction.

57. The device of claim 54, characterized in that the tilting of the cups is limited to 15° with respect to their neutral, vertical position in each direction.

58. The device of claim 1, characterized in that the tilting of the cups is limited to 15° with respect to their neutral, vertical position in each direction.

* * * * *